US011403996B2

(12) United States Patent
Nakanishi et al.

(10) Patent No.: US 11,403,996 B2
(45) Date of Patent: Aug. 2, 2022

(54) DISPLAY DRIVING DEVICE AND DISPLAY DRIVING METHOD

(71) Applicant: Panasonic Intellectual Property Management Co., Ltd., Osaka (JP)

(72) Inventors: Hirokazu Nakanishi, Osaka (JP); Masahiro Tsujimoto, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/276,083

(22) PCT Filed: Aug. 6, 2019

(86) PCT No.: PCT/JP2019/030808

§ 371 (c)(1),
(2) Date: Mar. 12, 2021

(87) PCT Pub. No.: WO2020/059336

PCT Pub. Date: Mar. 26, 2020

(65) Prior Publication Data

US 2022/0051612 A1 Feb. 17, 2022

(30) Foreign Application Priority Data

Sep. 18, 2018 (JP) ..... JP2018-173958

(51) Int. Cl.
*G09G 3/32* (2016.01)
*G09G 3/20* (2006.01)

(52) U.S. Cl.
CPC ..... *G09G 3/32* (2013.01); *G09G 3/2014* (2013.01); *G09G 2360/16* (2013.01)

(58) Field of Classification Search
CPC ..... G09G 3/32; G09G 3/3208; G09G 3/2014; G09G 2360/16; G09G 3/3216; G09G 3/30;
(Continued)

(56) References Cited

U.S. PATENT DOCUMENTS 7,907,137 B2 * 3/2011 Shirasaki ..... G09G 3/325 345/212
7,986,287 B2 * 7/2011 Umezaki ..... G09G 3/3225 345/82
(Continued)

FOREIGN PATENT DOCUMENTS

JP H07-325553 A 12/1995
JP 2009-211006 A 9/2009
JP 2012-142489 A 7/2012

OTHER PUBLICATIONS

International Search Report issued in corresponding International Patent Application No. PCT/JP2019/030808, dated Nov. 5, 2019, with English translation.

*Primary Examiner* — Vijay Shankar
(74) *Attorney, Agent, or Firm* — McDermott Will & Emery LLP

(57) ABSTRACT

The display driving device includes: a grouper that performs grouping of a plurality of light emitting elements (for example, light emitting elements arranged on a scanning line (for example, a scanning line of the display into one or more light emitting element groups (for example, light emitting element groups based on video information input; and a driver (for example, a cathode driver that drives the one or more light emitting element groups so that driving periods do not overlap.

14 Claims, 11 Drawing Sheets

(58) Field of Classification Search
CPC ..... G09G 3/22; G09G 2300/0426; G09G 2320/0223; G09G 2320/0233
See application file for complete search history.

(56) References Cited

U.S. PATENT DOCUMENTS

| | | | | |
|---|---|---|---|---|
| 9,891,747 | B2 * | 2/2018 | Jang | G06F 3/041662 |
| 9,990,883 | B2 * | 6/2018 | Park | G09G 3/3266 |
| 2012/0169786 | A1 | 7/2012 | Okuyama et al. | |

* cited by examiner

APL: AVERAGE BRIGHTNESS

| APL(%) min | APL(%) max | INDEX |
|---|---|---|
| 0 | 10 | 1 |
| 11 | 20 | 1 |
| 21 | 30 | 1 |
| 31 | 40 | 2 |
| 41 | 50 | 2 |
| 51 | 60 | 3 |
| 61 | 70 | 3 |
| 71 | 80 | 4 |
| 81 | 90 | 4 |
| 91 | 100 | 5 |

| INDEX | TOTAL NUMBER OF DIVISION |
|---|---|
| 1 | 1 |
| 2 | 2 |
| 3 | 3 |
| 4 | 4 |
| 5 | 5 |

DISPLAY DRIVING DEVICE AND DISPLAY DRIVING METHOD

CROSS-REFERENCE OF RELATED APPLICATIONS

This application is the U.S. National Phase under 35 U.S.C. § 371 of International Patent Application No. PCT/JP2019/030808, filed on Aug. 6, 2019, which in turn claims the benefit of Japanese Patent Application No. 2018-173958, dated Sep. 18, 2018, the entire disclosures of which Applications are incorporated by reference herein.

TECHNICAL FIELD

The present disclosure relates to a display driving device for driving a display and a method for driving the display.

BACKGROUND ART

Patent Literature (PTL) 1 discloses a display driving device (image forming device) that drives a display by sequentially driving light emitting elements (electron emitting elements) arranged two-dimensionally. In this display driving device, a plurality of light emitting elements arranged on a scanning line are divided into at least two light emitting element groups (blocks), and each of the light emitting element groups is driven so that the driving periods do not overlap with each other.

CITATION LIST

Patent Literature

PTL 1: Japanese Unexamined Patent Application Publication No. H7-325553

SUMMARY OF THE INVENTION

Technical Problems

The present disclosure provides a display driving device or the like that suppresses a decrease in the voltage applied to the light emitting elements and also suppresses a decrease in the brightness of the display.

Solutions to Problems

The display driving device according to the present disclosure is a display driving device that drives a display, the display driving device including: a grouper that performs grouping of a plurality of light emitting elements arranged on a scanning line of the display into one or more light emitting element groups based on video information input; and a driver that drives the one or more light emitting element groups so that driving periods do not overlap.

Method for driving a display according to the present disclosure, the method includes: performing grouping of a plurality of light emitting elements arranged on a scanning line of the display into one or more light emitting element groups based on input information; and driving the one or more light emitting element groups so that driving periods do not overlap.

Advantageous Effect of Invention

The display driving device and the like of the present disclosure are effective in suppressing a decrease in the voltage applied to the light emitting elements, and also suppressing a decrease in the brightness of the display.

DESCRIPTION OF EXEMPLARY EMBODIMENTS

Hereinafter, embodiments will be described in detail with reference to the drawings as appropriate. However detailed description more than necessary may be omitted. For example, detailed description of already well known matters and duplicate description for substantially the same configuration may be omitted. This is to avoid unnecessary redundancy of the following description and to facilitate the understanding of those skilled in the art.

It should be noted that the accompanying drawings and the following description will be provided in order for those skilled in the art to fully understand the present disclosure, and these are not intended to limit the subject matter described in the claims.

Embodiment

1. Basic Configuration of Display Driving Device

First, the basic configuration of display driving device 1 will be described with reference to FIG. 1 to FIG. 6.

Figure 1:
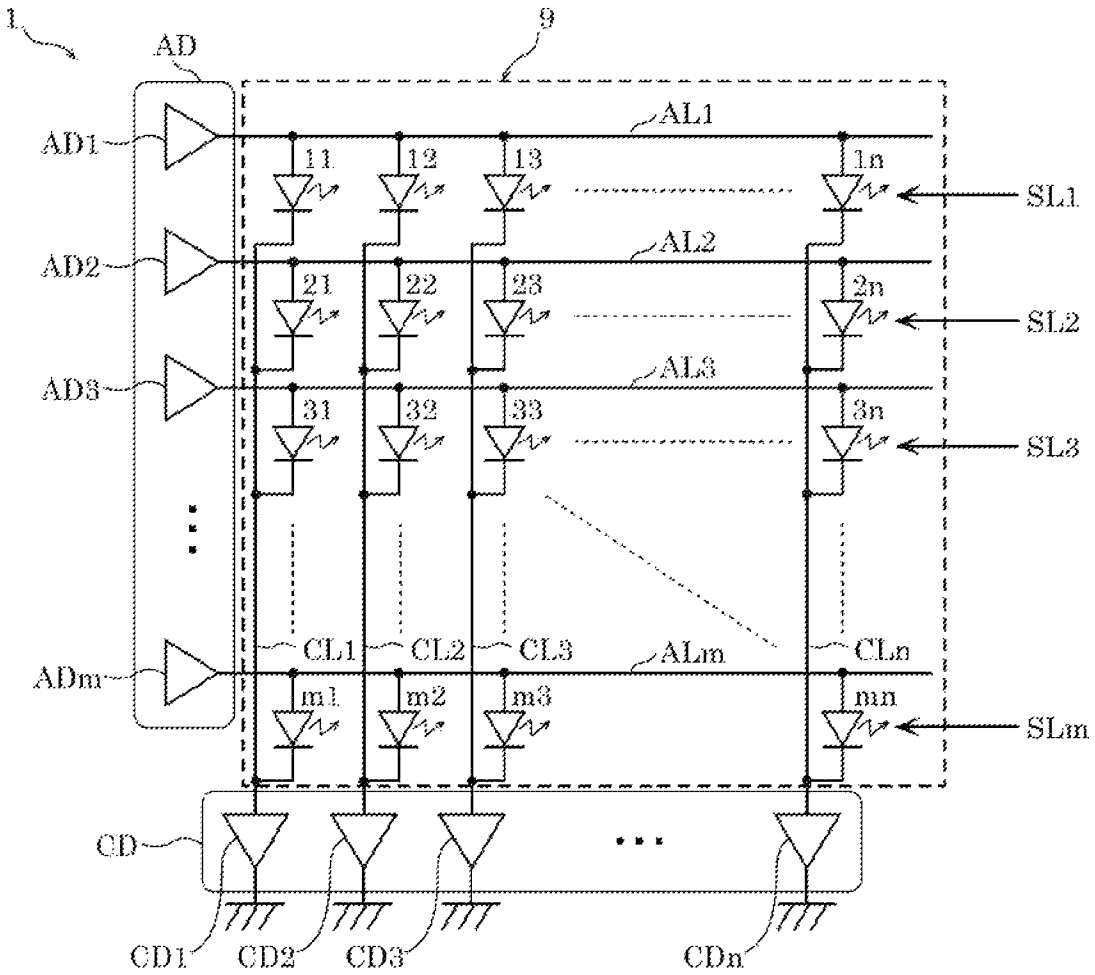
FIG. 1 is as circuit diagram of a display driving device according to a embodiment.

FIG. 1 is a circuit diagram of display driving device 1 according to the embodiment. It should be noted that each of letters m and n in the reference numerals of FIG. 1 indicates an integer of 2 or more.

As shown in FIG. 1, display driving device 1 includes anode driver AD and cathode driver CD. Anode driver AD is configured by a plurality of anode drivers AD1, AD2, AD3, . . . , ADm. Cathode driver CD is configured by a plurality of cathode drivers CD1, CD2, CD3, . . . , CDn. Each of anode drivers AD1 to ADm and cathode drivers CD1 to CDn is connected to display 9.

Display 9 includes a plurality of light emitting elements 11 to 1*n*, 21 to 2*n*, 31 to 3*n*, . . . , m1 to mn arranged in m rows and n columns. In addition, display 9 includes a plurality of anode wirings AL1, AL2, AL3, . . . , ALm extending in the horizontal direction, and a plurality of cathode wirings CL1, CL2, CL3, . . . , CLn extending in the vertical direction.

Scanning line SL1 on the first line of display 9 is configured by light emitting elements 11 to 1*n* arranged in the horizontal direction, scanning line SL2 is configured by light emitting elements 21 to 2*n*, scanning line SL3 is configured by light emitting elements 31 to 3*n*, and scanning line SLm is configured by light emitting elements m1 to mn.

Hereinafter, all or a part of the plurality of light emitting elements 11 to 1*n*, 21 to 2*n*, 31 to 3*n*, . . . , M1 to mn may be referred to as light emitting element 10.

Each light emitting element 10 is, for example, a light emitting diode (LED) element. Each light emitting element 10 may be a micro LED element having a width or length of 10 μm or more and 100 μm or less. In such a micro LED element, the wiring widths of anode wirings AL1 to ALm and cathode wirings CL1 to CLn connected to the micro LED element are narrower than those of the LED element larger than 100 μm. In addition, each light emitting element 10 may be an element that emits red, green, or blue light.

Display driving device 1 is a passive matrix type driving device, and is not provided with a transistor or the like connected to light emitting element 10 on display 9. For example, the respective anodes of light emitting elements m1 to mn arranged in the horizontal direction is connected to anode driver ADm via anode wiring ALm. In addition, the respective cathodes of light emitting elements 1*n* to mn arranged in the vertical direction is connected to cathode driver CDn via cathode wiring CLn.

Each light emitting element 10 emits light by a voltage being applied to by driving anode driver AD and cathode driver CD. For example, light emitting element mn emits when the anode of light emitting element mn is set to high (Hi) by anode driver ADm, the cathode of light emitting element mn is set to low (Low) by cathode driver CDn, and a voltage equal to or higher than a threshold is applied to light emitting element mn.

Display driving device 1 of the present embodiment can take, for example, both forms of a form in which light emitting elements 21 to 2*n* arranged on scanning line SL2 of display 9 are collectively driven, and a form in which light emitting elements 21 to 2*n* are divided into a plurality of light emitting element groups and are dividedly driven. Hereinafter, the collective driving and the divided driving of scanning line SL2 in display 9 will be described.

First, the collective driving of display 9 will be described with reference to FIG. 2 and FIG. 3.

Figure 2:
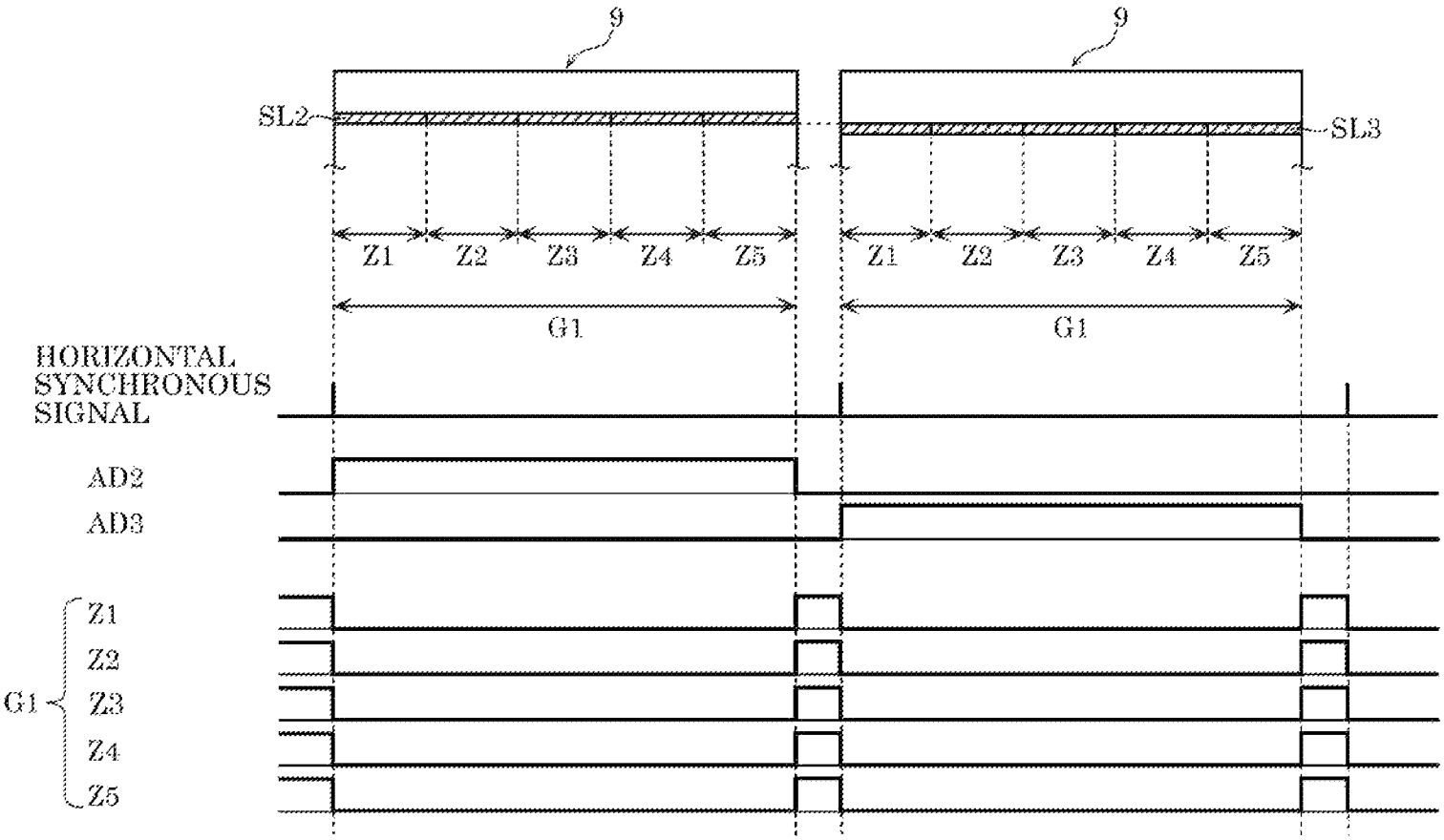
FIG. 2 is a diagram showing an example in which scanning lines are collectively driven by the display driving device according to the embodiment.

FIG. 2 is a diagram showing an example in which scanning lines are collectively driven by display driving device 1. It should be noted that in FIG. 2, scanning lines SL2 and SL3 of scanning lines SL1 to SLm will be described as an example.

As shown in FIG. 2, each of scanning lines SL2 and SL3 is divided into five horizontally arranged zones Z1, Z2, Z3, Z4 and Z5. In the example shown in FIG. 2, light emitting elements 21 to 2*n* and 31 to 3*n* provided in zones Z1 to Z5 are collectively driven row by row. That is, light emitting elements 21 to 2*n* and 31 to 3*n* are collectively driven for each light emitting element group G1 shown in FIG. 2.

First, light emitting elements 21 to 2*n* arranged on scanning line SL2 are collectively driven by anode driver AD2 and cathode driver CD. Next, light emitting elements 31 to 3*n* arranged on scanning line SL3 are collectively driven by anode driver AD3 and cathode driver CD. Other scanning lines are also collectively driven in the same manner, and thereby one frame of an image is displayed on display 9.

However, when scanning line SL2 is collectively driven as described above, the voltage applied to the light emitting elements may decrease.

Figure 3:
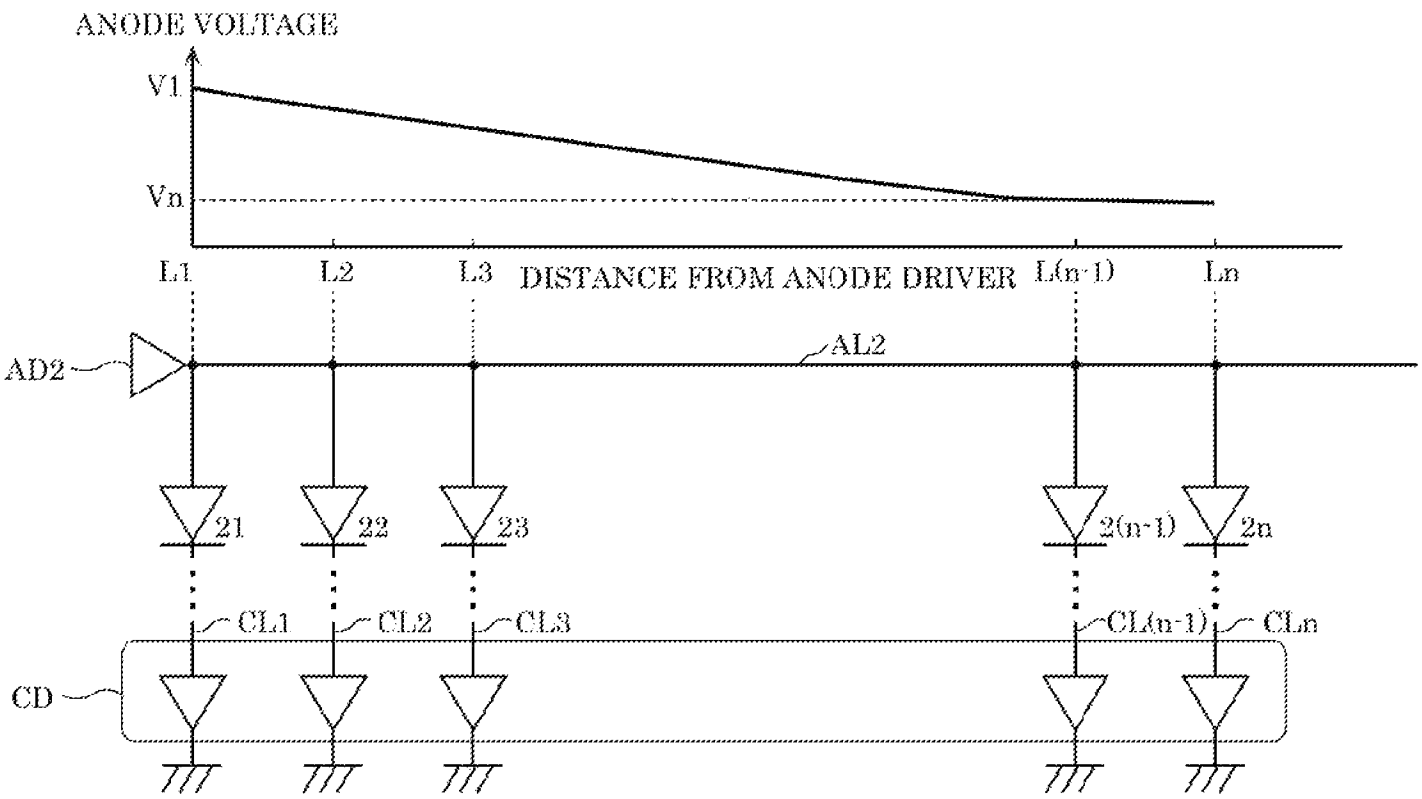
FIG. 3 is a diagram showing a voltage drop when the scanning lines are collectively driven by the display driving device according to the embodiment.

FIG. 3 is a diagram showing a voltage drop when scanning line SL2 is collectively driven by display driving device 1.

As shown in FIG. 3, the voltage applied to light emitting element 21 closest to anode driver AD2 shows almost the same value as the voltage output from anode driver AD2. However, when light emitting elements 21 to 2*n* are made to emit light collectively, the integrated wiring resistance increases as the distance from anode driver AD2 increases, and a voltage drop occurs in anode wiring AL2. Thus, for example, there is a problem that the voltage applied to light emitting element 2*n* farthest from anode driver AD2 decreases and light emitting element 2*n* does not emit light.

Then, in order to prevent the voltage applied to light emitting elements 21 to 2*n* from decreasing more than necessary, it is conceivable to perform grouping of light emitting elements 21 to 2*n* arranged on scanning line SL2 and drive them in time division, that is, drive them dividedly.

Figure 4:
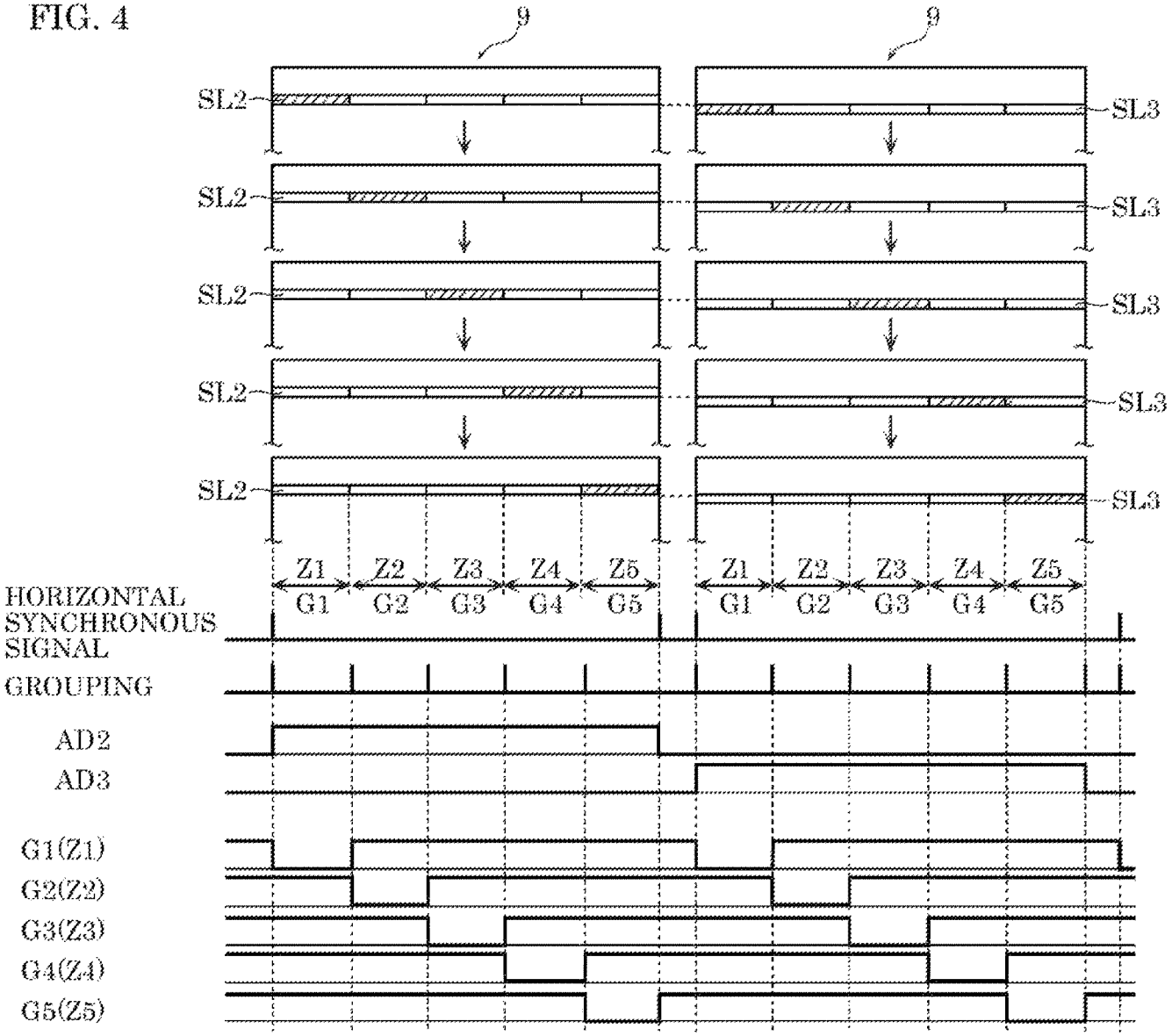
FIG. 4 is a diagram showing an example in which the scanning lines are dividedly driven by the display driving device according to the embodiment.

FIG. 4 is a diagram showing an example in which the scanning lines are dividedly driven by display driving device 1. It should be noted that also in FIG. 4, scanning lines SL2 and SL3 of scanning lines SL1 to SLm will be described as an example.

In FIG. 4, light emitting elements 21 to 2*n* arranged on scanning line SL2 are grouped into five light emitting element groups G1, G2, G3, G4, and G5 so as to correspond to five zones Z1 to Z5. In addition, light emitting elements 31 to 3*n* arranged on scanning line SL3 are also grouped into five light emitting element groups G1 to G5 so as to correspond to zones Z1 to Z5. In the example shown in FIG. 4, these light emitting element groups G1 to G5 are dividedly driven so that the driving periods do not overlap with each other.

First, light emitting element groups G1 to G5 are sequentially and dividedly driven by anode driver AD2 and cathode drivers CD1 to CDn. Next, light emitting element groups G1 to G5 are sequentially and dividedly driven by anode driver AD3 and cathode drivers CD1 to CDn. Other scanning lines are also dividedly driven in the same manner, and thereby one frame of an image is displayed on display 9.

Figure 5:
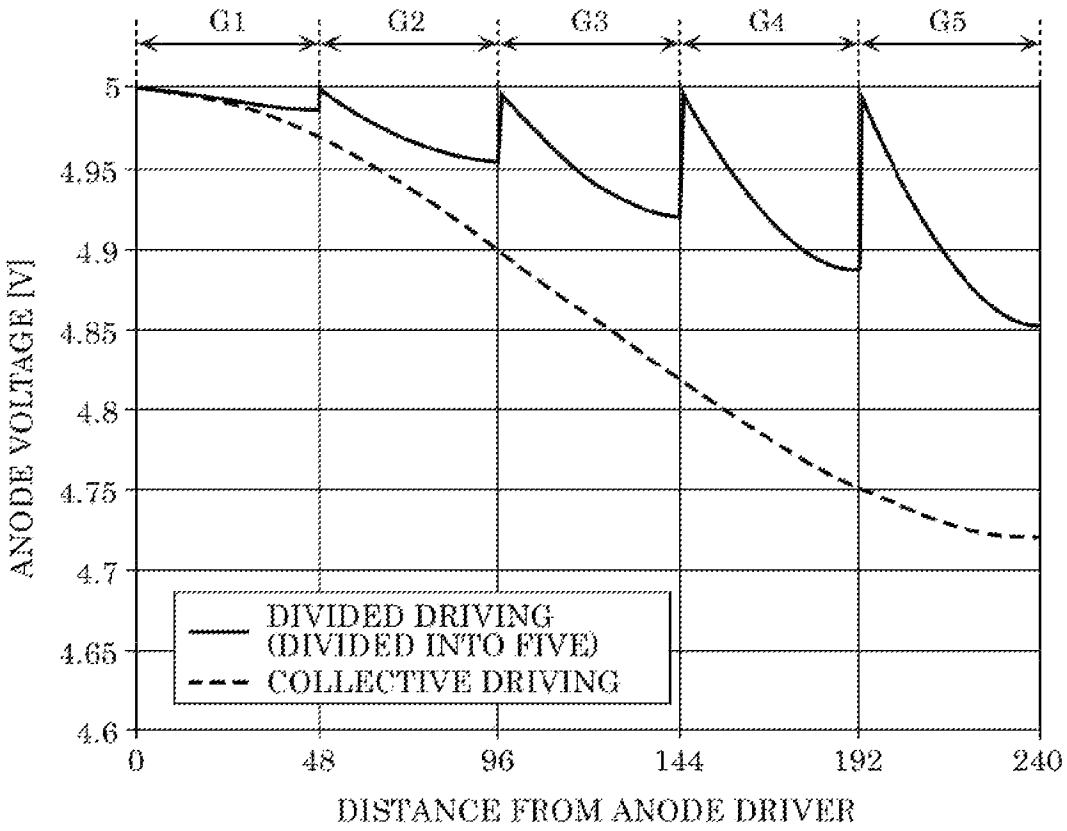
FIG. 5 is a diagram showing a voltage drop when the scanning lines are collectively driven and dividedly driven by the display driving device according to the embodiment.

FIG. 5 is a diagram (diagram shown by simulation) showing a voltage drop when the scanning lines are collectively driven and dividedly driven by display driving device 1.

FIG. 5 shows the anode voltage detected when 240 light emitting elements arranged in the horizontal direction are collectively driven. It should be noted that the distance from anode driver AD shown on the horizontal axis is represented in the order of arrangement of the light emitting elements on the basis of anode driver AD.

In addition, FIG. 5 shows the anode voltage of each of light emitting element groups G1 to G5 detected when the 240 light emitting elements are divided into five light emitting element groups G1 to G5 and sequentially driven. It should be noted that light emitting element groups G1 to G5 are actually driven in different periods from each other, but in this figure, the anode voltages detected by the driving of light emitting element groups G1 to G5 are shown in the same coordinates.

As shown in FIG. 5, in the case of the collective driving, the anode voltage decreases from 5V to 4.72V. On the other hand, in the case of the divided driving, for example, the minimum anode voltage of light emitting element group G5 is 4.85 V, and the decrease in the anode voltage is suppressed as compared with the case of the collective driving. In this way, when a plurality of light emitting elements arranged on the scanning line are divided into light emitting element groups G1 to G5 and dividedly driven, it is possible to suppress a decrease in the anode voltage.

However, when the divided driving as shown above is performed, for example, the total light emission time for light emitting elements 21 to 2*n* to emit on scanning line SL2 becomes shorter than the light emission time when light emitting elements 21 to 2*n* are collectively driven. Therefore, there is a problem that the brightness of display 9 decreases.

Therefore, in the present embodiment, it is selected according to the situation, for example, whether light emitting elements 21 to 2*n* arranged on scanning line SL2 are collectively driven, or light emitting elements 21 to 2*n* are divided into a plurality of light emitting element groups G1 to G5 and dividedly driven. Specifically, based on the video information input to display driving device 1, the above selection is made so that each of the problems of the collective driving and divided driving is unlikely to occur. Hereinafter, the concept of the present embodiment will be described with reference to FIG. 6.

Figure 6:
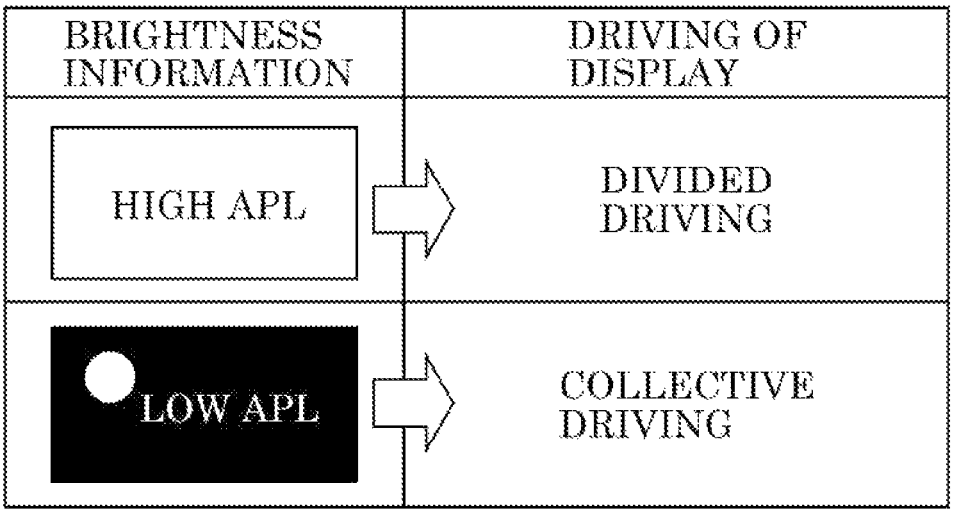
FIG. 6 is a diagram conceptually showing the operation of the display driving device according to the embodiment.

FIG. 6 is a diagram conceptually showing the operation of display driving device 1.

FIG. 6 shows an example of changing whether display 9 is dividedly driven or collectively driven based on the video information input to display driving device 1. Specifically, when the average brightness (APL: Average Picture Level) of display 9 included in the video information is high, there is no problem even if the brightness of display 9 slightly decreases, so that the divided driving is performed to suppress the decrease in the voltage applied to light emitting elements. On the other hand, when the average brightness of display 9 is low, the amount of light emitted or the number of light emitted by the light emitting elements is small, and even if the voltage drops, it is not easily affected by the voltage drop, so that the collective driving is performed to suppress the decrease in the brightness.

In this way, by determining whether to drive dividedly or collectively based on the video information input to display driving device 1, it is possible to suppress a decrease in the voltage applied to light emitting elements 11 to mn, and also suppress a decrease in the brightness of display 9. It should be noted that the present disclosure can be used not only for selecting whether to drive dividedly or collectively, but also for selecting, for example, whether the total number of divided groups in the divided driving is 5 or 2. It should be noted that the total number of divided groups does not have to be 5, and the maximum total number of divided groups in the horizontal direction may be the same as the number of pixels in the horizontal direction.

2. Detailed Configuration of Display Driving Device

Next, the detailed configuration of display driving device 1 will be described with reference to FIG. 7.

Figure 7:
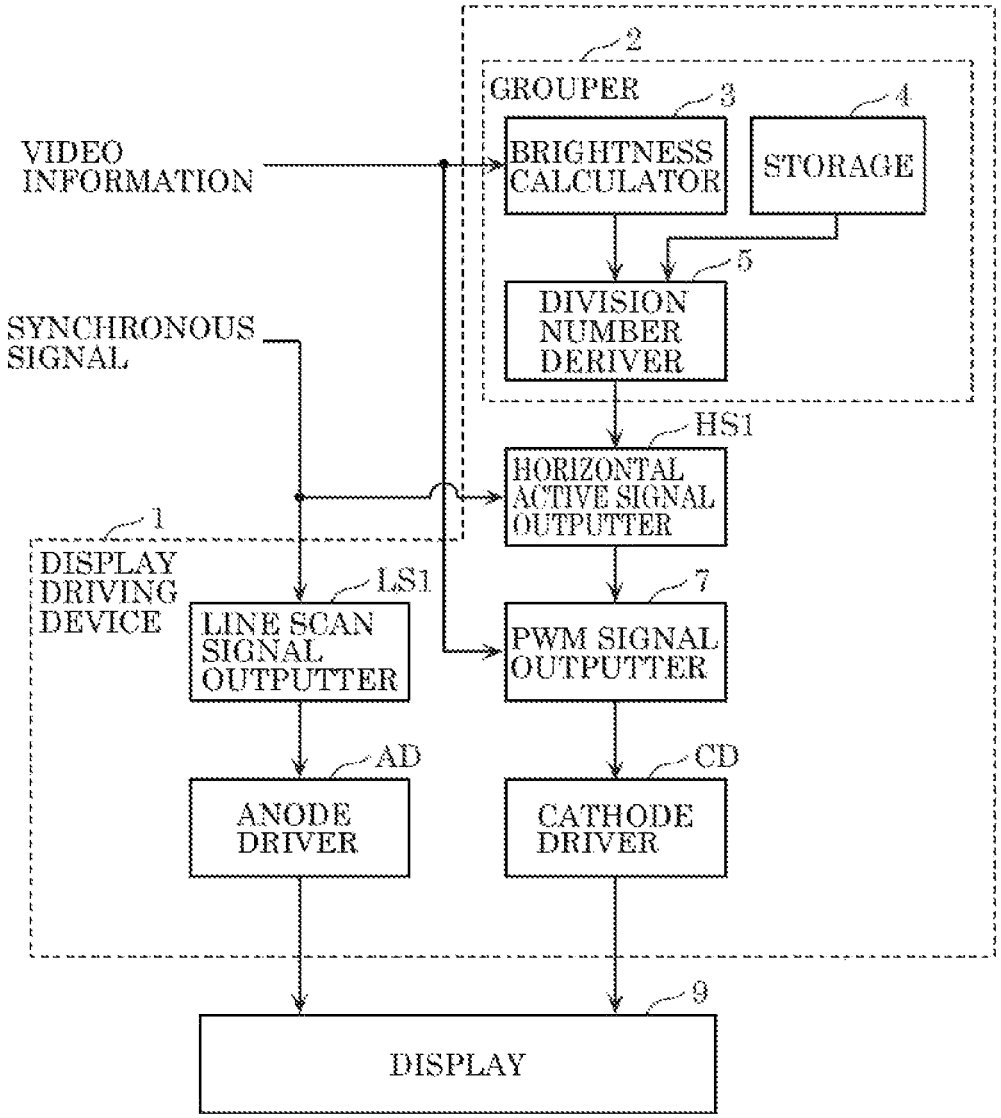
FIG. 7 is a block configuration diagram showing the display driving device according to the embodiment.

FIG. 7 is a block configuration diagram showing display driving device 1.

Display driving device 1 includes grouper 2, horizontal active signal outputter HS1, pulse width modulation (PWM) signal outputter 7, and cathode driver CD. In addition, display driving device 1 includes line scan signal outputter LS1 and anode driver AD.

These grouper 2, horizontal active signal outputter HS1, PWM signal outputter 7, and line scan signal outputter LS1 are configured, for example, by a central processing unit (CPU) that performs arithmetic processing, a read only memory (ROM) that stores various programs, a random access memory (RAM) that temporarily stores data such as video information, and the like. It should be noted that grouper 2 can be realized not only by software but also by hardware that does not use a CPU.

Grouper 2 performs grouping of a plurality of light emitting elements 10 arranged on a scanning line of display 9 into one or more light emitting element groups based on the video information input to grouper 2. For example, grouper 2 performs grouping of a plurality of light emitting elements 21 to 2*n* on scanning line SL2 into light emitting element groups G1 to G5.

Grouper 2 determines the total number of divided groups, which is the number of groups when performing grouping, based on the brightness information included in the video information. The total number of divided groups is selected from, for example, 1 or more and 5 or less. It should be noted that when the total number of divided groups is 1, the driving is the collective driving described above. Grouper 2 may determine the total number of divided groups based on not only the brightness information but also information such as the lighting rate of light emitting elements 10.

As shown in FIG. 7, grouper 2 includes brightness calculator 3, storage 4, and division number deriver 5.

Brightness calculator 3 calculates the average brightness (APL) of display 9 based on the input video information. The average brightness is a value obtained by averaging the brightness of the image to be displayed on display 9, and is calculated from video data or the like. Specifically, brightness calculator 3 calculates the average brightness based on the video information per frame output to display 9. For example, the average brightness when all light emitting elements 10 on display 9 are made to emit light at a standard intensity of 100% is 100%, and the average brightness when light emitting elements 10 are not made to emit light is 0%.

Storage 4 stores a predetermined relationship between the average brightness and the total number of divided groups.

Figure 8:
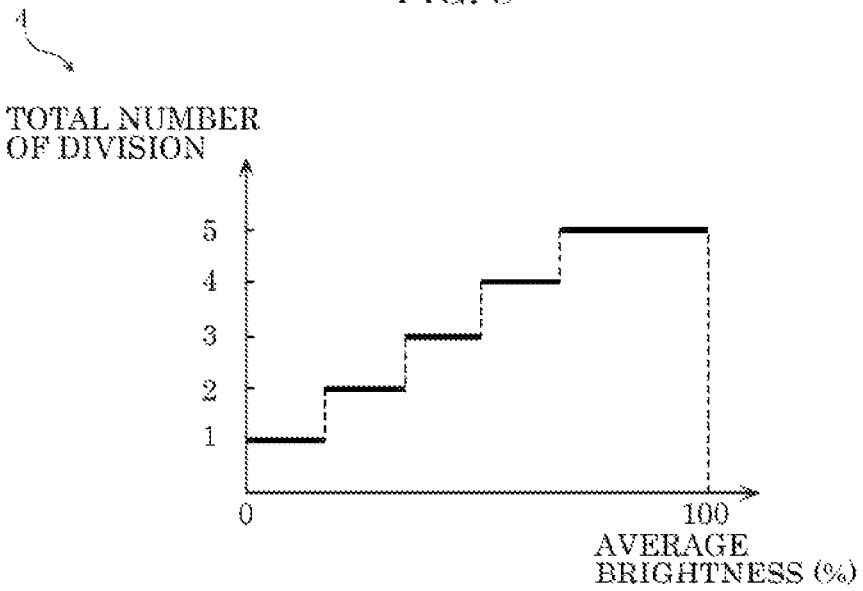
FIG. 8 is a diagram showing the relationship between the average brightness and the total number of divided groups that are stored in the storage of the display driving device according to the embodiment.

FIG. 8 is a diagram showing the relationship between the average brightness and the total number of divided groups stored in storage 4 of display driving device 1. The appropriate total number of divided groups corresponding to the average brightness of display 9 is shown as a graph in FIG. 8. These relationships are obtained, for example, by experiments and the like. The above relationships may be shown not only by a graph but also by a table or a calculation formula.

Division number deriver 5 derives the total number of divided groups based on the average brightness derived by brightness calculator 3 and the above relationship stored in storage 4. Specifically, division number deriver 5 derives the total number of divided groups per frame to be output to the display. For example, as shown in FIG. 8, if the average brightness of display 9 is 20%, the total number of divided groups is 1, and if the average brightness is 100%, the total number of divided groups is 5. In this way, grouper 2 performs grouping of light emitting elements 10 arranged on a scanning line based on the total number of divided groups derived by division number deriver 5.

Figure 9:
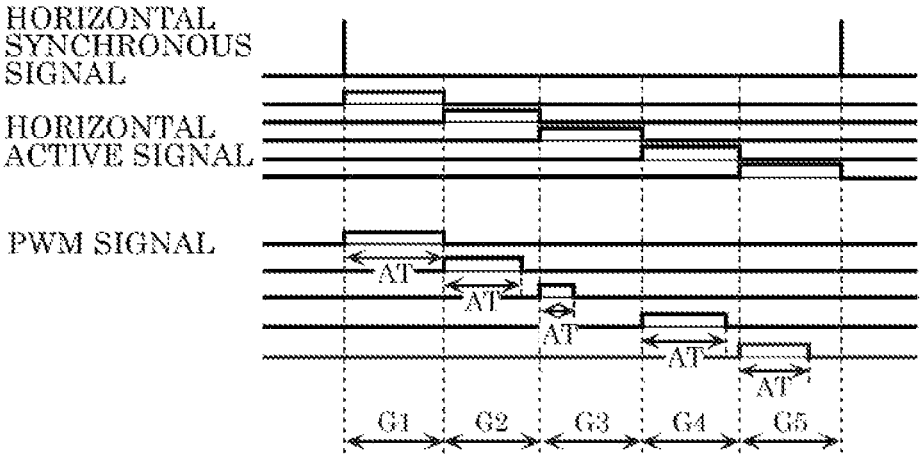
FIG. 9 is a diagram showing the operation of the horizontal active signal outputter and the PWM signal outputter of the display driving device according to the embodiment.

FIG. 9 is a diagram showing the operation of horizontal active signal outputter HS1 and PWM signal outputter 7 of display driving device 1.

Horizontal active signal outputter HS1 generates and outputs a horizontal active signal based on the total number of divided groups output from grouper 2 and based on the horizontal synchronous signal input to horizontal active signal outputter HS1. For example, horizontal active signal outputter HS1 outputs a signal indicating a period during which each of light emitting element groups G1 to G5 can be driven, based on the total number of divided groups "5" output from grouper 2.

PWM signal outputter 7 receives the horizontal active signal, calculates driving time AT of each of light emitting element groups G1 to G5 based on the video information input to PWM signal outputter 7, and outputs a PWM signal based on driving time AT calculated. For example, PWM signal outputter 7 outputs a signal having a wide pulse width when driving time AT of light emitting element group G1 is long, and outputs a signal having a narrow pulse width when driving time AT is short.

Cathode driver CD drives one or more light emitting element groups G1 to G5 based on the PWM signal output from PWM signal outputter 7. With this, light emitting element groups G1 to G5 are driven so that the driving periods do not overlap with each other. It should be noted that when there is only one light emitting element group obtained by performing grouping, they are inevitably driven so that the driving periods do not overlap.

Line scan signal outputter LS1 outputs a line scan signal based on the vertical synchronous signal input to line scan signal outputter LS1. Anode driver AD scans scanning lines SL1 to SLm based on the input line scan signal. With this, one frame of image is displayed on display 9.

3. Method of Driving Display

Next, a method of driving display 9 will be described with reference to FIG. 10 and FIG. 11.

Figure 10:
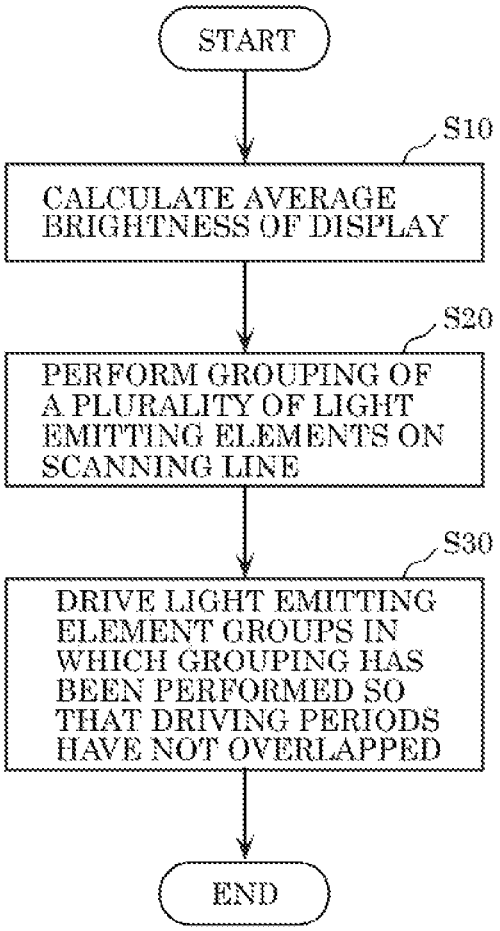
FIG. 10 is a flowchart showing a display driving method according to the embodiment.

FIG. 10 is a flowchart showing a driving method of display 9. FIG. 11 is a diagram showing an example of the operation of display driving device 1. It should be noted that in FIG. 11, scanning line SL2 of scanning lines SL1 to SLm will be described as an example. In addition, display driving device 1 creates a moving image for 1 second, for example, by displaying an image of 60 frames per second, but here, the first frame and the second frame of the 60 frames will be described as an example.

First, an example of displaying an image in the first frame will be described.

Figure 11:
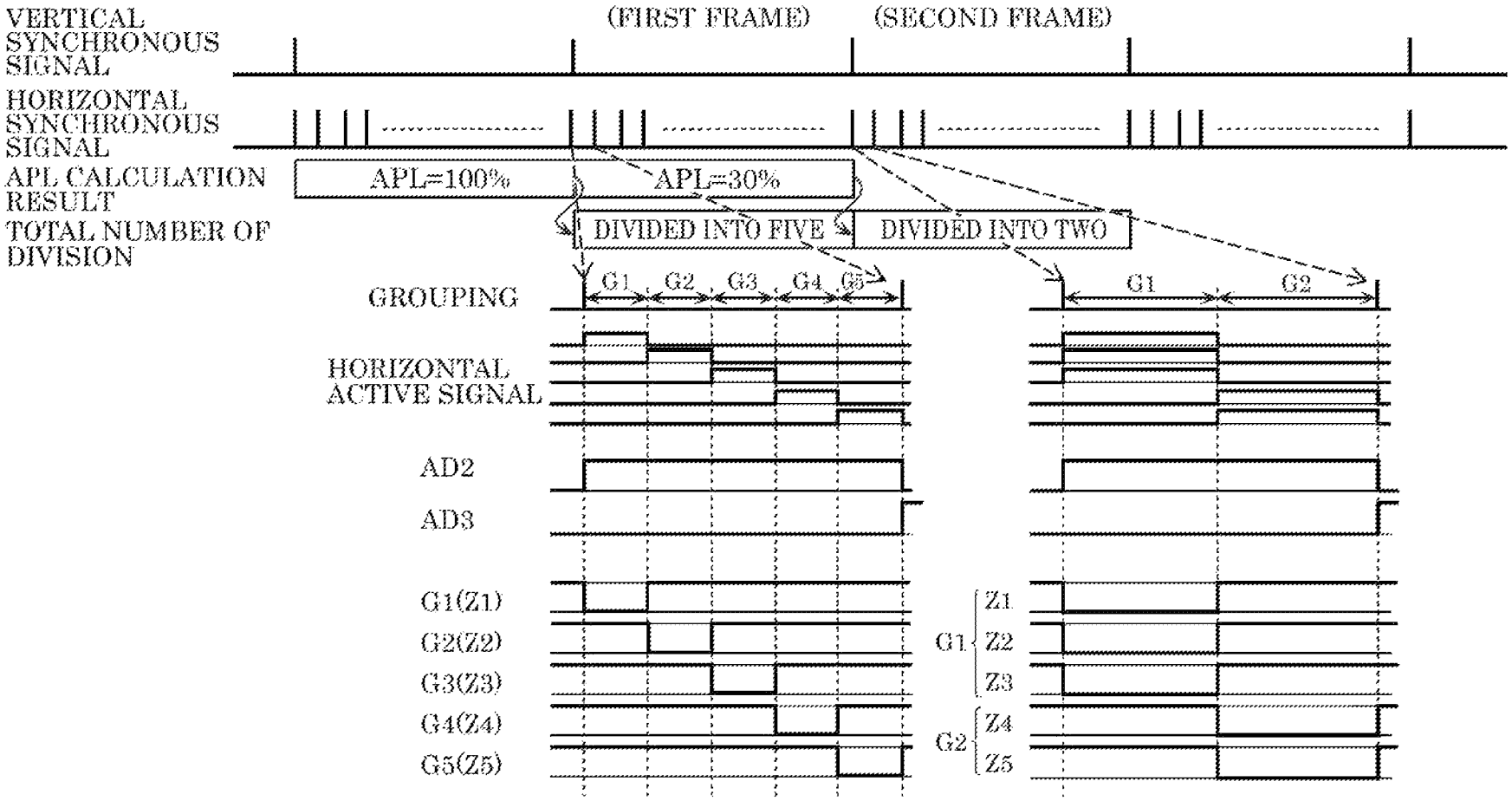
FIG. 11 is a diagram showing an example of the operation of the display driving device according to the embodiment.

A synchronous signal is input to display driving device 1 as shown in FIG. 11. Display driving device 1 calculates the average brightness of display 9 with this synchronous signal as a trigger (step S10). Specifically, as described above, the average brightness is calculated based on the video information per frame output to display 9. This calculation of the average brightness is performed before displaying the image in the first frame. FIG. 11 shows that the average brightness of the first frame is 100% as a result of the calculation.

Next, a plurality of light emitting elements 21 to 2*n* on scanning line SL2 are grouped (step S20). Specifically, the total number of divided groups for performing grouping is determined based on the average brightness obtained in step S10. More specifically, the total number of divided groups is obtained based on the average brightness described above and the relationship stored in storage 4. In this example, since the average brightness of the first frame is 100%, the total number of divided groups is "5" (see FIG. 8). Then, the grouping of scanning line SL2 is performed based on the obtained total number of divided groups. For example, as shown in FIG. 11, a plurality of light emitting elements arranged on scanning line SL2 are grouped into five light emitting element groups G1 to G5.

Next, grouped light emitting element groups G1 to G5 are driven sequentially so that the driving periods do not overlap with each other (step S30). With this, light emitting element groups G1 to G5 on scanning line SL2 are driven in time division. Other scanning lines are also dividedly driven in the same manner, and thereby the image of the first frame is displayed on display 9.

Next, an example of displaying an image in the second frame will be described.

First, the average brightness of display 9 is calculated (step S10). FIG. 11 shows that the average brightness of the second frame is 30%.

Next, a plurality of light emitting elements 21 to 2*n* on scanning line SL2 are grouped (step S20). In this example, since the average brightness of the second frame is 30%, the total number of divided groups is "2" (see FIG. 8). Then, grouping of scanning line SL2 is performed based on the obtained total number of divided groups. Specifically, for example, as shown in FIG. 11, a plurality of light emitting elements arranged on scanning line SL2 are grouped into two light emitting element groups G1 and G2.

Next, grouped light emitting element groups G1 and G2 are driven so that the driving periods do not overlap with each other (step S30). With this, light emitting element groups G1 and G2 on scanning line SL2 are driven in time division. Other scanning lines are also dividedly driven in the same manner, and thereby the image of the second frame is displayed on display 9.

In this way, in the present embodiment, light emitting elements 21 to 2*n* arranged on scanning line SL2 are grouped based on the input video information and driven for each group. With this, it is possible to suppress a decrease in the voltage applied to light emitting elements 21 to 2*n*, and also suppress a decrease in the brightness of display 9.

It should be noted that an example in which zones Z1 to Z3 are allocated to light emitting element group G1 and zones Z4 and Z5 are allocated to light emitting element group G2 is shown in the above example, but the example of allocating zones Z1 to Z5 is not limited thereto. For example, in the above example, zones Z1 and Z2 may be allocated to light emitting element group G1, and zones Z3 to Z5 may be allocated to light emitting element group G2. In addition, when the total number of divided groups is 3, zones Z1 and Z2 may be allocated to light emitting element group G1, zones Z3 and Z4 may be allocated to light emitting element group G2, and zone Z5 may be allocated to light emitting element group G3. When the total number of divided groups is 4, zones Z1 and Z2 may be allocated to light emitting element group G1, zone Z3 may be allocated to light emitting element group G2, zone Z4 may be allocated to light emitting element group G3, and zone Z5 may be allocated to light emitting element group G4.

4. Effects, Etc.

As described above, in the present embodiment, display driving device 1 includes grouper 2 that performs grouping of a plurality of light emitting elements (for example, light emitting elements 21 to 2*n*) arranged on a scanning line (for example, scanning line SL2) of display 9 into one or more light emitting element groups (for example, light emitting element groups G1 to G5) based on video information input, and a driver (for example, cathode driver CD) that drives the above one or more light emitting element groups so that the driving periods do not overlap with each other.

In this way, by grouping light emitting elements 21 to 2*n* arranged on scanning line SL2 based on the input video information and driving each group, can be obtained. it is possible to suppress a decrease in the voltage applied to light emitting elements 21 to 2*n*, and also suppress a decrease in the brightness of display 9.

In addition, grouper 2 may determine the total number of divided groups when performing grouping based on the brightness information included in the video information.

In this way, by determining the total number of divided groups based on the brightness information, the grouping can be performed appropriately. With this, it is possible to suppress a decrease in the voltage applied to the light emitting elements, and also suppress a decrease in the brightness of display 9.

In addition, grouper 2 may include brightness calculator 3 that calculates an average brightness of display 9 based on the video information input, storage 4 that stores a relationship between a predetermined average brightness and the total number of divided groups when performing the grouping; and division number deriver 5 that derives the total number of divided groups based on the average brightness calculated by brightness calculator 3 and the above relationship stored in the storage.

In this way, the total number of divided groups can be appropriately determined by deriving the total number of divided groups based on the average brightness calculated by brightness calculator 3 and the above relationship stored in storage 4. With this, it is possible to suppress a decrease in the voltage applied to the light emitting elements, and also suppress a decrease in the brightness of display 9.

In addition, brightness calculator 3 may calculate the average brightness based on the video information per frame output to display 9, and division number deriver 5 may derive the total number of divided groups per frame.

According to this configuration, the total number of divided groups can be determined per frame. With this, it is possible to suppress a decrease in the voltage applied to the light emitting elements per frame and suppress a decrease in the brightness of display 9.

In addition, the display driving device may further include PWM signal outputter 7 that calculates a driving time of the one or more light emitting element groups based on the video information and outputs a PWM signal based on driving time AT, wherein the driver may drive the one or more light emitting element groups based on the PWM signal output from PWM signal outputter 7.

In this way, the amount of light emitted from light emitting elements 10 can be adjusted by changing driving time AT of the light emitting element groups based on the video information.

In addition, the total number of divided groups may be 1 or more and 5 or less.

According to this, the number of light emitting elements 10 for grouping can be easily determined from 1 or more and 5 or less.

In addition, each of the plurality of light emitting elements 10 may be an LED element.

According to this, one or more light emitting element groups can be easily driven so that the driving periods do not overlap with each other.

In addition, the driver may include cathode driver CD that is directly connected to the cathodes of the LED elements via cathode wirings CL1 to CLn, and anode driver AD that is directly connected to the anodes of the LED elements via anode wirings AL1 to ALm.

According to this, one or more light emitting element groups can be driven by a simple circuit configuration.

In addition, the width or length of the LED element may be 10 μm or more and 100 μm or less.

For example, even when a small LED element is used as light emitting element 10 and the width of the wiring connected to the LED element is narrow, according to display driving device 1 of the present disclosure, it is possible to suppress a decrease in the voltage applied to the LED element.

In addition, in the present embodiment, the method for driving display 9 includes performing grouping of a plurality of light emitting elements (for example, light emitting elements 21 to 2*n*) arranged on a scanning line (for example, scanning line SL2) of display 9 into one or more light emitting element groups (for example, light emitting element groups G1 to G5) based on input information, and driving the one or more light emitting element groups so that driving periods do not overlap.

In this way, by grouping light emitting elements 21 to 2*n* arranged on scanning line SL2 based on the input video information and driving each group, it is possible to suppress a decrease in the voltage applied to light emitting elements 21 to 2*n*, and also suppress a decrease in the brightness of display 9.

Other Embodiments

Figure 12:
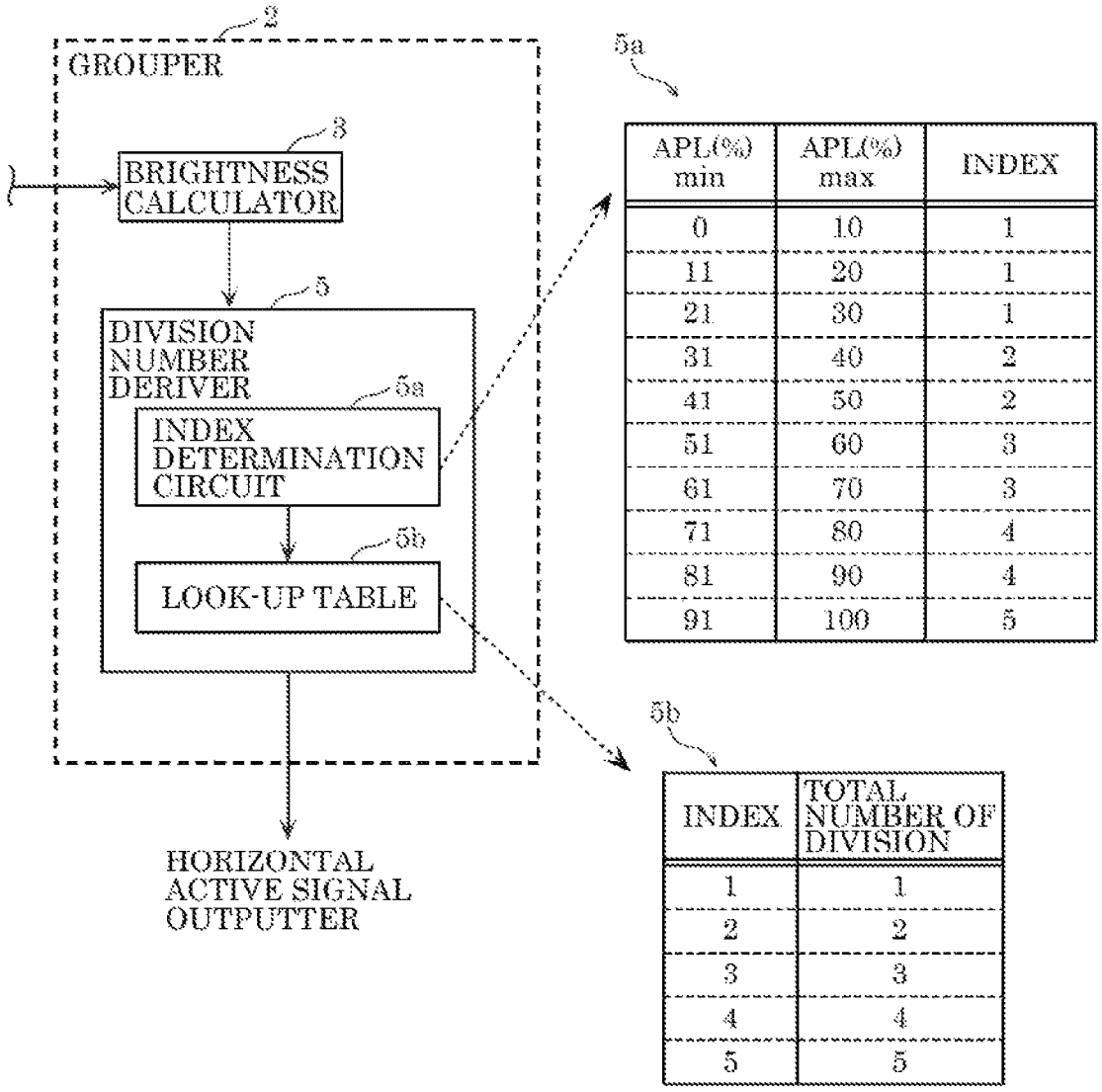
FIG. 12 is a diagram showing a grouper of a display driving device according to another embodiment.

In the above embodiment, an example in which grouper 2 is realized by software is shown, but the present invention is not limited thereto, and grouper 2 can also be realized by hardware that does not use a CPU. FIG. 12 is a diagram showing grouper 2 of display driving device 1 according to another embodiment. For example, as shown in FIG. 12, division number deriver 5 may be configured by index determination circuit 5*a* and look-up table 5*b*. In this case, division number deriver 5 can obtain an index based on the average brightness (APL) using index determination circuit 5*a*, and derive the total number of divided groups based on the index obtained above using the look-up table 5*b*.

As described above, the embodiments have been described as examples of the technology in the present disclosure. For that reason, the accompanying drawings and detailed description have been provided.

Therefore, among the components described in the attached drawings and the detailed description, not only the components essential for solving the problem but also the components not essential for solving the problem in order to exemplify the above technology may be included. Therefore, the fact that these non-essential components are described in the accompanying drawings or detailed description should not immediately determine that those non-essential components are essential.

In addition, since the above-described embodiments are for exemplifying the technology in the present disclosure, various changes, replacements, additions, omissions and the like can be made within the scope of claims or the equivalent scope thereof.

INDUSTRIAL APPLICABILITY

The display driving device of the present disclosure is useful for a driving device or the like that drives a display on which LED elements are mounted.

The invention claimed is:

1. A display driving device that drives a display, the display driving device comprising:

a grouper that performs grouping of a plurality of light emitting elements arranged on a scanning line of the display into one or more light emitting element groups based on video information input; and a driver that drives the one or more light emitting element groups so that driving periods do not overlap, wherein the grouper includes:

a brightness calculator that calculates an average brightness of the display based on the video information input;

a storage that stores a relationship between a predetermined average brightness and the total number of divided groups when performing the grouping; and a division number deriver that derives the total number of divided groups based on the average brightness calculated by the brightness calculator and the relationship stored in the storage.

2. The display driving device according to claim 1, wherein the brightness calculator calculates the average brightness based on the video information per frame to be output to the display, and the division number deriver derives the total number of divided groups per the frame.

3. A display driving device that drives a display, the display driving device comprising:

a grouper that performs grouping of a plurality of light emitting elements arranged on a scanning line of the display into one or more light emitting element groups based on video information input; and a driver that drives the one or more light emitting element groups so that driving periods do not overlap, wherein the grouper determines a total number of divided groups when performing the grouping based on brightness information included in the video information.

4. The display driving device according to claim 3, further comprising:

a pulse width modulation (PWM) signal outputter that calculates a driving time of the one or more light emitting element groups based on the video information and outputs a PWM signal based on the driving time, wherein the driver drives the one or more light emitting element groups based on the PWM signal output from the PWM signal outputter.

5. The display driving device according to claim 3, wherein the total number of divided groups is 1 or more and 5 or less.

6. The display driving device according to claim 3, wherein each of the plurality of light emitting elements is a light emitting diode (LED) element.

7. The display driving device according to claim 6, wherein the driver includes a cathode driver that is directly connected to a cathode of the LED element via cathode wiring and an anode driver that is directly connected to an anode of the LED element via anode wiring.

8. The display driving device according to claim 6, wherein a width or length of the LED element is 10 μm or more and 100 μm or less.

9. A display driving method for driving a display, the method comprising:

performing grouping of a plurality of light emitting elements arranged on a scanning line of the display into one or more light emitting element groups based on input information; and driving the one or more light emitting element groups so that driving periods do not overlap, wherein, when performing the grouping, a total number of divided groups is determined based on brightness information included in the video information.

10. A display driving device that drives a display, the display driving device comprising:

a grouper that performs grouping of a plurality of light emitting elements arranged on a scanning line of the display into two or more light emitting element groups based on video information input; and a driver that switches between first driving of driving all the plurality of light emitting elements arranged on the scanning line and second driving of driving the two or more light emitting element groups so that driving periods do not overlap.

11. The display driving device according to claim 10, wherein the driver switches between the first driving and the second driving based on brightness information included in the video information.

12. The display driving device according to claim 10, wherein the grouper determines a total number of divided groups when performing the grouping based on the brightness information included in the video information.

13. The display driving device according to claim 10, wherein the grouper includes:

a brightness calculator that calculates an average brightness of the display based on the video information input;

a storage that stores a relationship between a predetermined average brightness and the total number of divided groups when performing the grouping; and a division number deriver that derives the total number of divided groups based on the average brightness calculated by the brightness calculator and the relationship stored in the storage.

14. The display driving device according to claim 10, wherein:

each of the plurality of light emitting elements is a light emitting diode (LED) element, and the driver includes a cathode driver that is directly connected to a cathode of the LED element via cathode wiring and an anode driver that is directly connected to an anode of the LED element via anode wiring.

* * * * *